US007922169B2

(12) United States Patent
Mandel

(10) Patent No.: US 7,922,169 B2
(45) Date of Patent: Apr. 12, 2011

(54) FRICTION RETARD FEEDER

(75) Inventor: Barry Paul Mandel, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 36 days.

(21) Appl. No.: 12/260,483

(22) Filed: Oct. 29, 2008

(65) Prior Publication Data

US 2010/0102501 A1 Apr. 29, 2010

(51) Int. Cl.
*B65H 3/52* (2006.01)

(52) U.S. Cl. ..... 271/121

(58) Field of Classification Search ..... 271/121–125
See application file for complete search history.

(56) References Cited

U.S. PATENT DOCUMENTS

| | | | | |
|---|---|---|---|---|
| 4,368,881 | A | 1/1983 | Landa | |
| 4,917,370 | A | 4/1990 | Batts | |
| 4,971,304 | A | 11/1990 | Lofthus | |
| 5,062,599 | A * | 11/1991 | Kriegel et al. | 271/35 |
| 5,094,442 | A | 3/1992 | Kamprath et al. | |
| 5,114,251 | A | 5/1992 | Mahoney | |
| 5,169,140 | A | 12/1992 | Wenthe, Jr. | |
| 5,219,159 | A | 6/1993 | Malachowski et al. | |
| 5,278,624 | A | 1/1994 | Kamprath et al. | |
| RE35,026 | E | 8/1995 | Mahoney | |
| 5,474,287 | A * | 12/1995 | Takahashi | 271/10.13 |
| 5,531,311 | A | 7/1996 | LeMay et al. | |
| 5,697,608 | A | 12/1997 | Castelli et al. | |
| 5,887,996 | A | 3/1999 | Castelli et al. | |
| 6,137,989 | A | 10/2000 | Quesnel | |
| 6,168,153 | B1 | 1/2001 | Richards et al. | |
| 6,354,584 | B1 | 3/2002 | Suga et al. | |
| 6,378,858 | B1 | 4/2002 | Suga | |
| 6,494,451 | B2 | 12/2002 | Michel | |
| 6,533,268 | B2 | 3/2003 | Williams et al. | |
| 6,550,759 | B2 | 4/2003 | Kotaka et al. | |
| 7,243,917 | B2 | 7/2007 | Knierim et al. | |
| 2003/0146567 | A1 | 8/2003 | Williams et al. | |
| 2005/0035531 | A1 * | 2/2005 | Sasaki et al. | 271/126 |
| 2006/0261540 | A1 | 11/2006 | Loiselle et al. | |

FOREIGN PATENT DOCUMENTS

JP 5-178483 * 7/1993

OTHER PUBLICATIONS

Karns, Karl L. "An Empirical Evaluation of Nip Mechanics as it Impacts Paper Drive Variability in a Registration System", Xerox Internal Report Data Sheet, Accession No. X9500117, Issued May 9, 1995.

* cited by examiner

*Primary Examiner* — Stefanos Karmis
*Assistant Examiner* — Thomas A Morrison
(74) *Attorney, Agent, or Firm* — Pepper Hamilton LLP

(57) ABSTRACT

Sheet feeding systems and methods for using such systems to feed a sheet from a stack in a document processing system are disclosed. An exemplary sheet feeding system may include a feed roll, a retard system, a trailing edge retention system and a system for automatically an selectively separating the feed roll and the retard system. The feed roll may be configured to drive a first sheet of a stack of sheets in a process direction. The retard system may be configured to prevent one or more second sheets from being driven in the process direction. The trailing edge retention system may be configured to automatically and selectively retain one or more second sheets in the stack by applying a force to a trailing portion of at least one second sheet, thus allowing the feed roll and retard system to be separated during much of the feed cycle. As a result, wear of the feed roll and/or retard system may be reduced.

8 Claims, 8 Drawing Sheets

FRICTION RETARD FEEDER

BACKGROUND

The present disclosure generally relates to document processing devices and methods for operating such devices. More specifically, the present disclosure relates to methods and systems for extending roll life in feed nips of a friction retard feeder.

Friction retard feeders are subsystems of a document processing system that are typically used to initiate reliable transport of a sheet from a tray to the remainder of the document processing system while preventing the transport of more than one sheet simultaneously. For example, in the case of a printer, scanner or other similar device, a friction retard feeder can be used to remove the top sheet of paper or other media from a paper tray so that it can be utilized by the remainder of the device while preventing underlying sheets from being transported. This reduces the possibility of jamming the device during operation.

Friction retard feeders are typically either active or semi-active in nature. An active friction retard feeder, such as is shown in FIG. 1A, includes a nudger roll 105, a feed roll 110 and a retard roll 115 having a reverse direction rotating shaft and a slip clutch 120. The nudger roll 105 is used to drive the top sheet on a stack of sheets to the feed roll 110. The feed roll 110 is rotated such that a media to be transported, such as paper, that contacts the feed roll is transported in a process direction. The retard roll 115 is connected to a drive shaft that causes the retard roll to rotate in a direction that would transport a sheet in a direction opposite to the process direction when active. However, a slip clutch 120 coupled to the drive shaft disengages the retard roll 115 from the drive shaft when a torque sufficient to overcome the torque of the slip clutch is present. As such, when the retard roll 115 contacts either the feed roll 110 directly or if only one sheet enters the feed nip (i.e., is between the feed roll and the retard roll) as is shown in FIG. 1B, the slip clutch 120 slips (i.e., the torque of the slip clutch is overcome) and the retard roll rotates in the process direction. However, if more than one sheet enters the feed nip as shown in FIG. 1C, the sheet-to-sheet friction force on the bottom sheet(s) is insufficient to overcome the torque of the slip clutch 120 and the retard roll 115 rotates opposite to the process direction (i.e., in a non-process direction).

The active friction retard feeder operates on a differential friction principle by employing a feed roll 110 that has a high coefficient of friction with respect to the media and a retard roll 115 that has a coefficient of friction with respect to the media that is lower than that of the feed roll, but higher than the coefficient of friction between two sheets. As such, the feed roll 110 transports the top sheet in the process direction because it has a high coefficient of friction with the sheet. Moreover, the sheet has a coefficient of friction (due to the force imparted by the feed roll 110) to overcome the torque supplied by the slip clutch 120 causing the retard roll 115 to be driven by the feed roll. If more than one sheet is drawn from the stack, the sheets other than the top sheet contact the retard roll 115 which prevents transport in the process direction because the torque of the slip clutch 120 is not overcome by the friction between the two sheets. As a result, only a single sheet, the top sheet, is transported in a process direction at a time.

A semi-active friction retard feeder, as shown in FIG. 2A, also includes a nudger roll 205, a feed roll 210 and a retard roll 215 having a slip clutch 220. Each of the nudger roll 205, feed roll 210 and retard roll 215 operate in a substantially similar manner to the corresponding components of the active friction retard feeder. However, the retard roll 215 of the semi-active friction retard feeder is not driven by a drive shaft. Rather, the retard roll 215 is merely rotatably mounted on a shaft. As such, when the torque of the slip clutch 220 is not overcome (i.e., when more than one sheet is present), the retard roll 215 merely remains immobile instead of actively driving the sheets other than the top sheet in the non-process direction.

An alternate friction retard feeder (such as is shown in FIG. 3) includes a retard pad 315 instead of a retard roll, such as 115 or 215. In order to prevent feeding of more than one sheet, the retard pad 315 must have a lower coefficient of friction with respect to a sheet than the feed roll 310, but a higher coefficient of friction with respect to a sheet than the coefficient of friction between two sheets.

Friction retard feeders are commonly incorporated into document processing systems that serve office and low end production markets because they have a low unit manufacturing cost and provide reliable feeding performance. One disadvantage of such feeders is that the feed and retard rolls wear out and need to be replaced frequently because of the shear forces on the elastomeric rolls due to drag forces and the force required to overcome the slip clutch torque. For document processing devices in low volume markets, this can be an acceptable limitation because of the limited amount of sheets which are passed through the feed nip. However, this disadvantage has restricted the use of friction retard feeders in higher volume markets.

Significant research has been performed in order to develop feed rolls that have a longer wear life. However, the effect of such research is limited by the fact that materials must also resist contamination from, for example, coated media, such as photo paper.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a sheet feeding system may include a feed roll, a retard system, a trailing edge retention system and a system for automatically and selectively separating the feed roll and the retard system. The feed roll may be configured to drive a first sheet of a stack of sheets in a process direction. The retard system may be configured to prevent one or more second sheets from being driven in the process direction. The trailing edge retention system may be configured to automatically and selectively retain one or more second sheets in the stack by applying a force to a trailing portion of at least one second sheet.

In an embodiment, a method of feeding a sheet from a stack in a document processing system that includes a nudger roll, a feed nip comprising a feed roll and a retard system, a take away nip, a plurality of sensors, and a trailing edge retention system may be performed. The method may include actuating the nudger roll to move a first sheet from a stack of sheets in a process direction, receiving a lead edge of the first sheet at the feed nip, moving, via the feed roll, the first sheet through the feed nip, actuating the trailing edge retention system to restrict movement of one or more second sheets in the stack of sheets, receiving the lead edge of the first sheet at a take away nip, automatically moving one or more of the feed roll and the retard system away from the first sheet, automatically moving one or more of the feed roll and the retard system back into a closed position, and automatically moving the trailing edge retention system away from the one or more second sheets.

BRIEF DESCRIPTION OF THE DRAWINGS

Aspects, features, benefits and advantages of the present invention will be apparent with regard to the following description and accompanying drawings, of which.

DETAILED DESCRIPTION

Figure 1A:
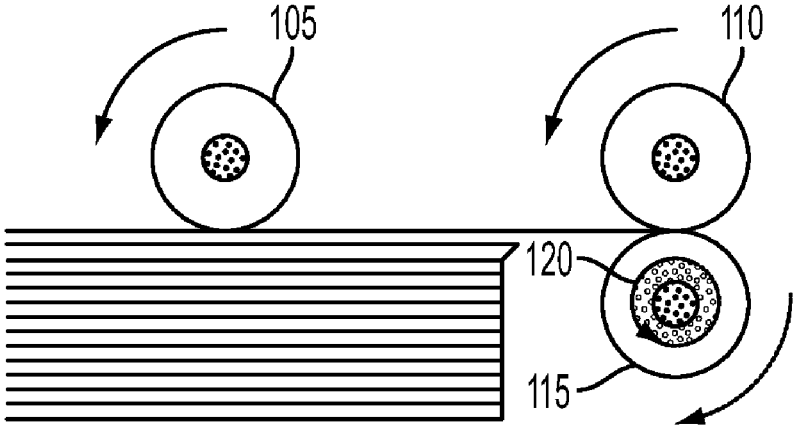
FIG. 1A PRIOR ART
FIGS. 1A-C depict side views of a conventional active friction retard feeder.
Figure 1B:
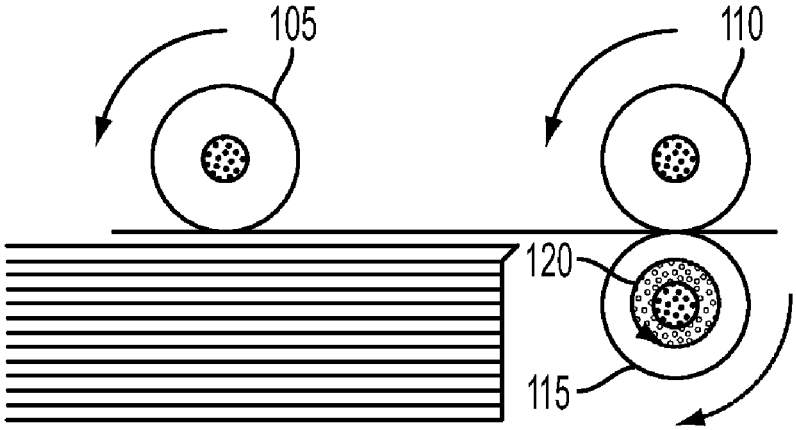
FIG. 1B PRIOR ART
Figure 1C:
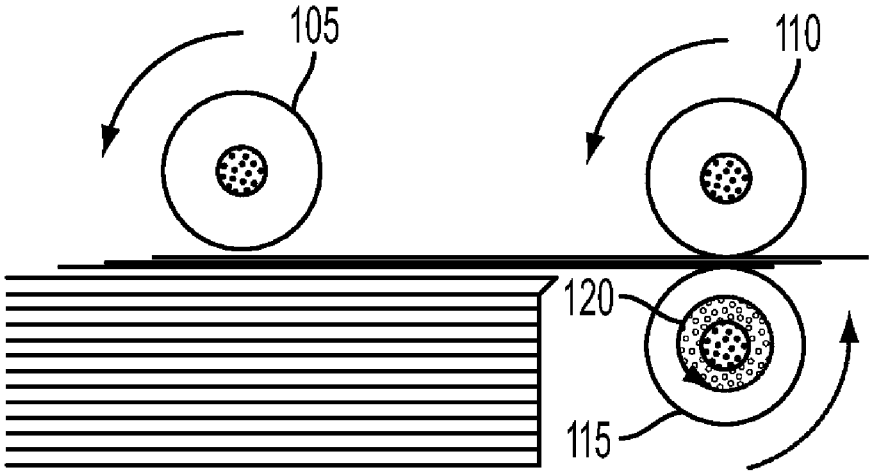
FIG. 1C PRIOR ART
Figure 2A:
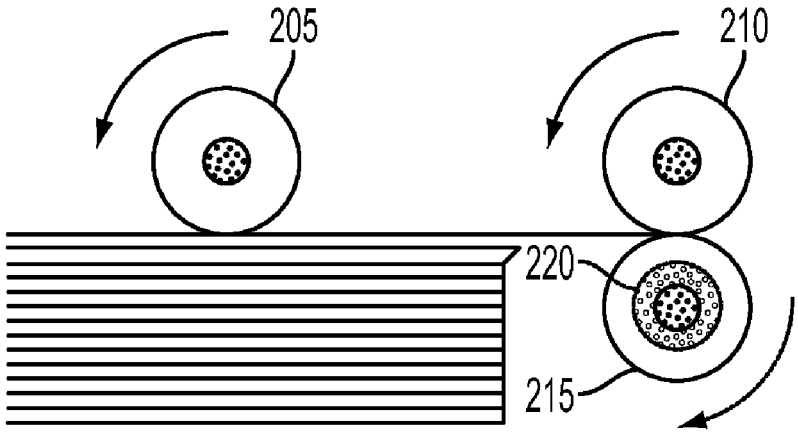
FIG. 2A PRIOR ART
FIGS. 2A-C depict side views of a conventional semi-active friction retard feeder.
Figure 2B:
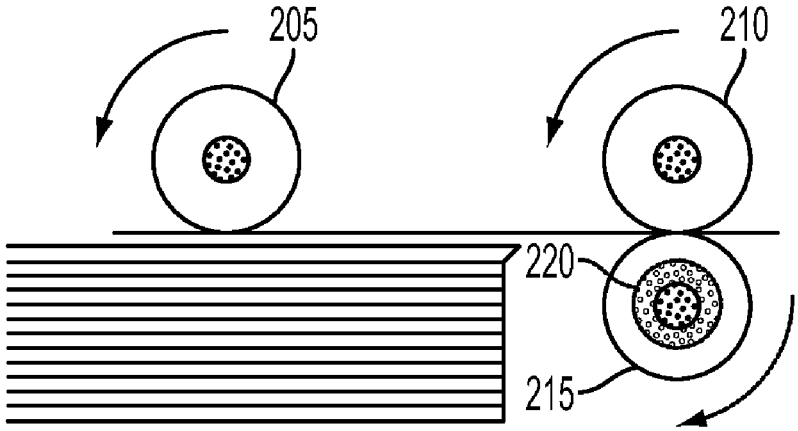
FIG. 2B PRIOR ART
Figure 2C:
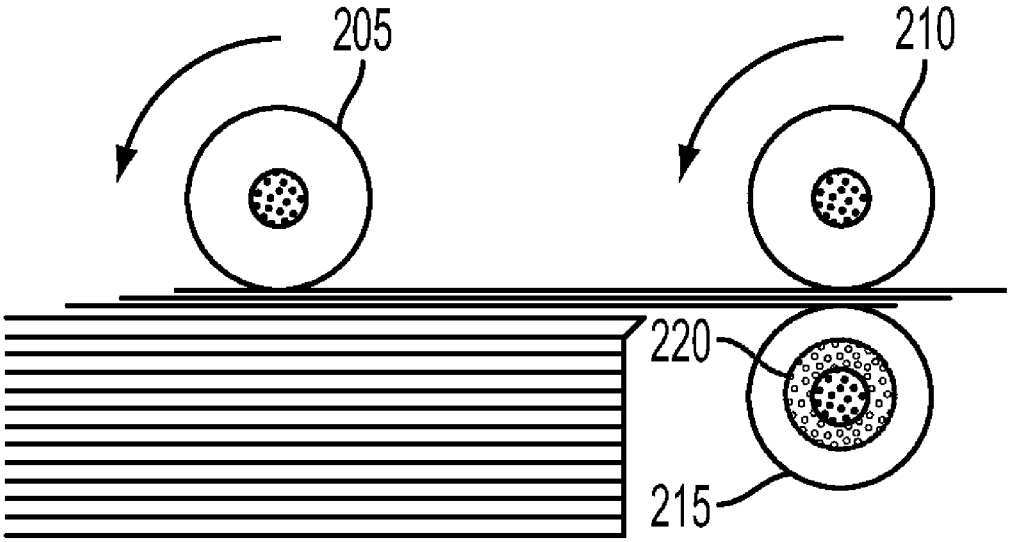
FIG. 2C PRIOR ART

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "nip" refers to a location in a document processing device at which a force is applied to a sheet by drive rollers to propel the sheet in a process direction. The "exit point" of a nip refers to the portion of the sheet path past the given nip. For example, a sensor that detects the lead edge of a sheet at the "exit point" of the feed nip, would detect a sheet after the lead edge passes the feed nip and before the lead edge enters the following nip.

FIGS. 4A-D depicts a side view of a portion of a document processing device including an exemplary friction retard feeder assembly according to an embodiment. As shown in FIGS. 4A-D, the friction retard feeder assembly 400 may include a nudger roll 405, a feed roll 410, a retard system, such as a retard roll 415, and a trailing edge retention system, such as trailing edge retention arm 420. The friction retard feeder assembly 400 may be used to transport a top sheet 425 to a take away nip including a take away roll 430 and an idler roll 435 while preventing other sheets, such as 440, from being transported to the take away nip simultaneously. In addition, the friction retard feeder assembly 400 may be configured to reduce wear on, and thus increase the longevity of, the feed roll 410 and the retard system 415. In an embodiment, the wear on the take away roll 430 may also be reduced as a result of the teachings described herein.

Figure 4A:
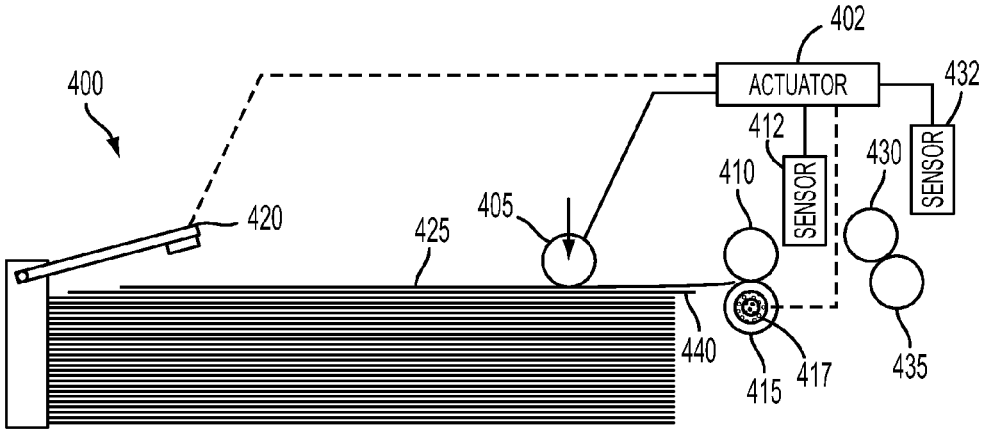
FIGS. 4A-D depict side views of a portion of a document processing device including an exemplary friction retard feeder assembly according to an embodiment.
Figure 4B:
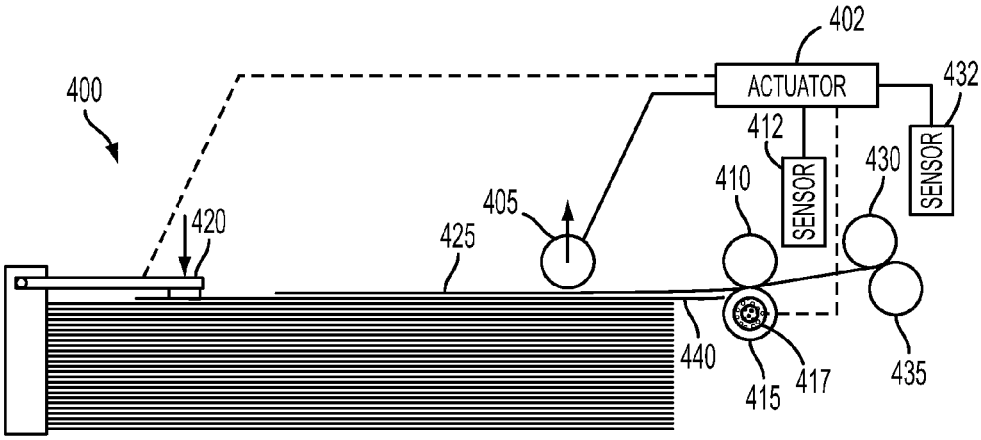

As shown in FIG. 4A, the nudger roll 405 is used to initiate movement of the top sheet 425 of a stack of sheets. The nudger roll 405 is placed in contact with the top sheet 425 of the stack and drives the top sheet towards the feed nip (i.e., the feed roll 410 and the retard system 415). In an embodiment, the nudger roll 405 may be left in contact with the top of the stack. Alternately, the nudger roll 405 can be moved up and down to effect the movement of each sheet in succession. For example, as shown in FIG. 4B, the nudger roll 405 may be moved up after transporting the top sheet 425 to the feed nip. The nudger roll 405 may later be moved down when a next sheet is desired to be transported to the feed nip and after the previous sheet has passed through the feed nip. Detection of the top sheet 425 reaching the feed nip may be performed using one or more sensors, such as 412.

The nudger roll 405 is configured to transport only a top sheet 425 from the stack in a process direction. However, the nudger roll 405 may inadvertently cause one or more additional sheets, such as 440, to at least be partially transported towards the feed nip because of friction between the top sheet 425 and the other sheets.

Figure 3:
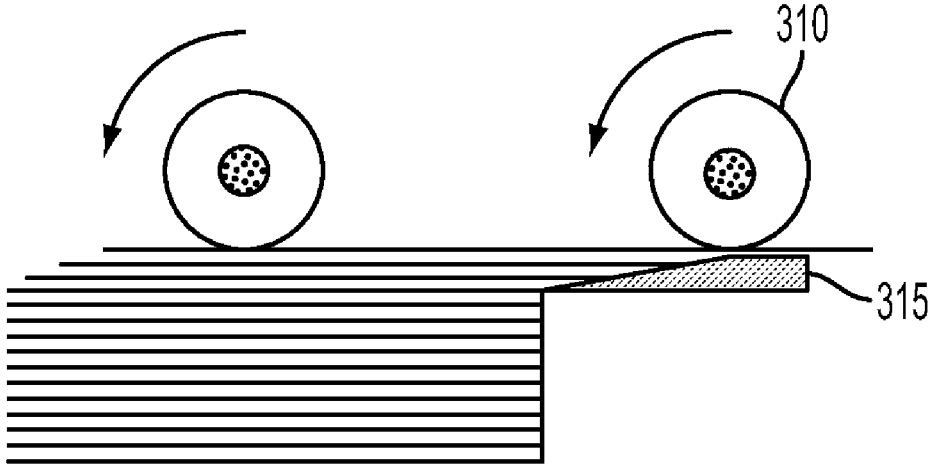
FIG. 3 PRIOR ART
FIG. 3 depicts a side view of a conventional pad friction retard feeder.

As shown in FIG. 4B, the feed roll 410 may be configured to rotate in such a manner that a top sheet 425 is transported in a process direction. The retard roll 415 may be configured to restrict other sheets, such as 440, from being transported in the process direction. The manner in which the retard roll 415 restricts the other sheets 440 from being transported in the process direction is dependent upon whether the feed nip is active or semi-active in nature. In an embodiment, the retard system 415 includes a rotatably mounted retard roll, a drive shaft for applying a torque on the retard roll of a magnitude and direction that rotates the retard roll in a non-process direction opposite to the process direction, and a slip clutch 417 coupled to the retard roll and the drive shaft and configured to prevent the retard roll from rotating in the non-process direction if the top sheet 425 contacts the retard roll and to enable the retard roll to rotate in the non-process direction if a sheet other than the top sheet 440 contacts the retard roll. In an alternate embodiment, the retard system 415 includes a rotatably mounted retard roll, a shaft, and a slip clutch 417 coupled to the shaft and the retard roll and configured to prevent the retard roll from rotating if a sheet other than the top sheet 440 contacts the retard roll and to enable the retard roll to rotate in a process direction if the top sheet 425 contacts the retard roll. Alternately, the retard system 415 may include a friction pad, such as the one shown in FIG. 3.

Figure 4C:
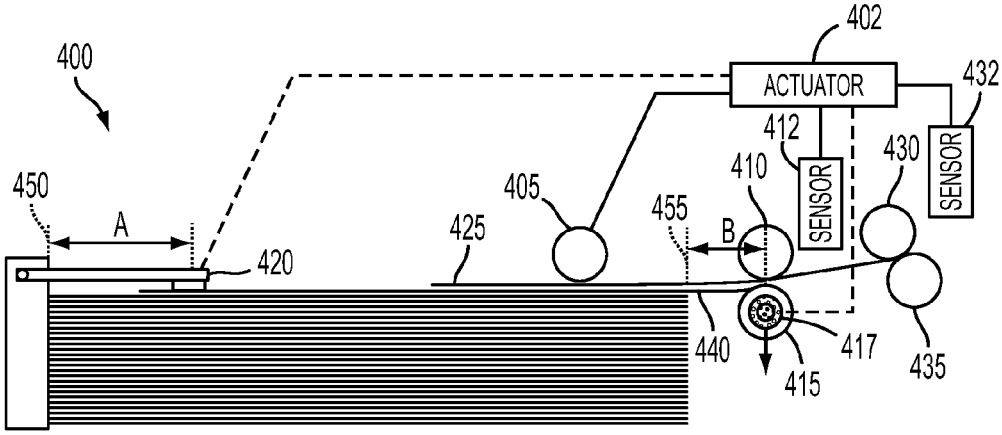

One or more of the feed roll 410 and the retard roll 415 may be moved away from or towards a process path (i.e., the path on which the top sheet 425 is transported) as part of the transport operation. For example, as shown in FIG. 4C, the retard roll 415 may be moved away from the process path after a lead edge of the top sheet 425 has reached the take away roll 430. The retard roll 415 may be moved towards the process path when a next sheet is desired to be transported. Detection of the top sheet 425 reaching the take away roll 430 may be performed using one or more sensors, such as 432.

The trailing edge retention system 420 may be used to further restrict sheets other than the top sheet, such as 440, from passing through the feed nip. The trailing edge retention system 420 may impart a force near a trailing edge of a sheet other than the top sheet, such as 440, when engaged, such as is shown in FIG. 4B. The force imparted by the trailing edge retention system 420 may restrict sheets other than the top sheet, such as 440, from moving in a process direction despite friction between the top sheet 425 and the other sheets, this may be required because the feed nip is open (i.e., the feed roll 410 is not in contact with the retard roll 415) for a portion of the time that the top sheet 425 is moving through the feed nip. When the feed nip is open, the retard roll 415 does not prevent the motion of sheets other than the top sheet, such as 440, past the feed nip. The retention arm therefore provides a mechanism for holding such sheets, such as 440, and subsequent sheets in place during the time that the feed nip is open. Other mechanisms for holding sheets other than the top sheet in place while the feed nip is open may be used within the scope of this disclosure.

The distance between the point at which the trailing edge retention system 420 contacts the remaining sheets, such as 440, and the trailing edge of the stack 450 (i.e., "A" in FIG. 4C) may be greater than the distance between the leading edge of the stack 455 and the feed roll 410 (i.e., "B" in FIG. 4C). As a result, sheets 440 that are prevented from passing the feed nip by the retard roll 415 may be held near the trailing edge of such sheets by the trailing edge retention system 420, when engaged.

Figure 4D:
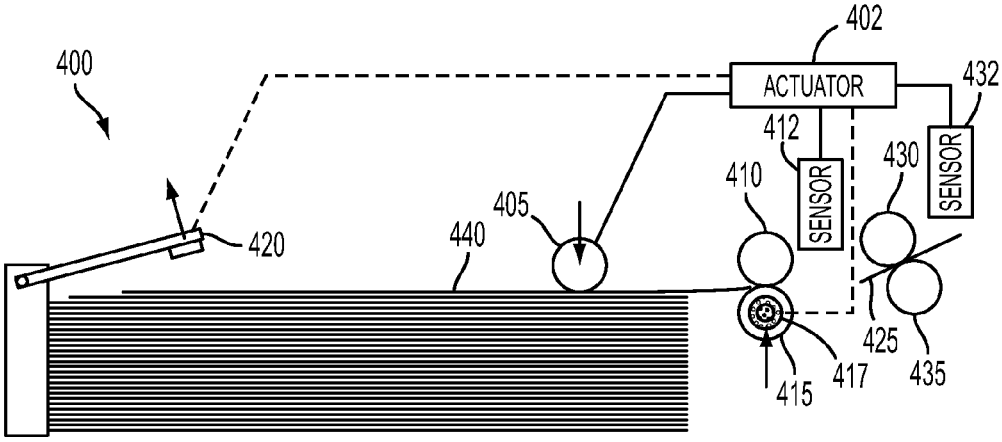

The trailing edge retention system 420 may disengage after the feed nip closes, as shown in FIG. 4D.

In an embodiment, the trailing edge retention system 420 and a system that separates the feed nip (i.e., by moving one or more of the feed roll 410 and the retard roll 415) may utilize a common actuator 402. For example, a single step motor could be used to drive two cams, one of which would lift the trailing edge retention system 420, and one of which would move the retard roll 415 away from the feed roll 410. In an alternate embodiment, a motor could be used to drive cams that drive the nudger roll lift mechanism and at least one of the trailing edge retention system 420 and feed nip release system. Alternatively, separate solenoid actuators 402 could be used to drive the trailing edge retention system 420 and feed nip release system.

In an embodiment, the trailing edge retention system 420 may be moved when sheets are loaded onto the stack. For example, if the stack is part of a tray that is pulled from a document processing device, the trailing edge retention system 420 may be located at a position that is directly over the stack, which could make it difficult to load sheets into the tray. As such, the trailing edge retention system 420 may be raised, lowered, rotated and/or otherwise moved as the tray is removed from the document processing device. In an embodiment, the trailing edge retention system 420 may be moved in response to the tray being removed from the document processing device, such as by using a triggering mechanism. For example, a spring loaded system may be used. The spring may be compressed when the tray is inserted into the document processing device, which may cause the trailing edge retention system 420 to be placed in a position from which it can restrict sheets as described above. Removing the tray from the document processing device may cause the spring to extend and move the trailing edge retention system 420 from its active position. Other methods for moving the trailing edge retention system 420 may be used within the scope of this disclosure.

Figure 5:
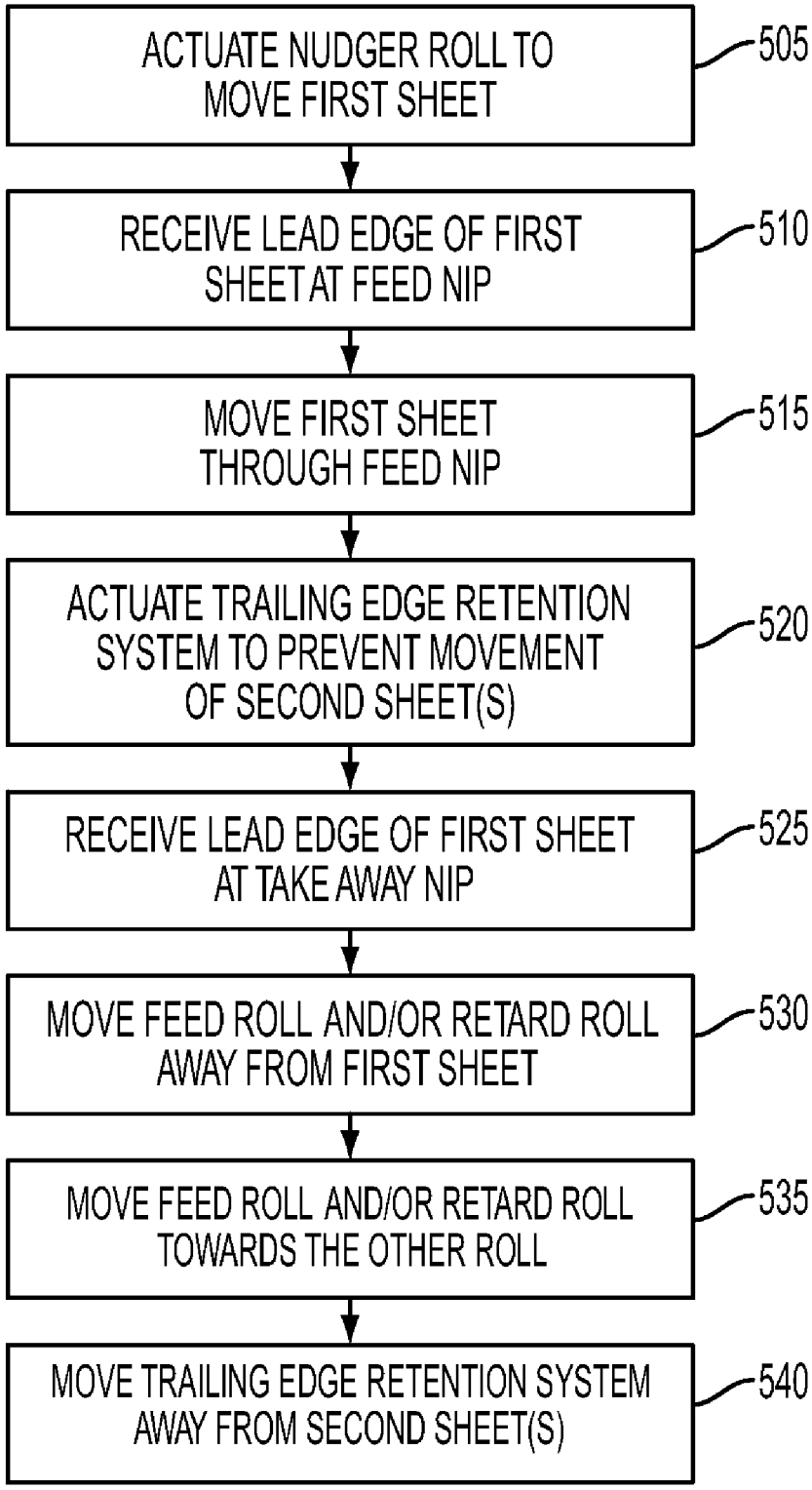
FIG. 5 depicts a flow diagram for an exemplary method of reducing roll wear in a sheet feeding system according to an embodiment.

FIG. 5 depicts a flow diagram for an exemplary method of reducing roll wear in a sheet feeding system according to an embodiment. As shown in FIG. 5, a nudger roll may be actuated 505 to move a first sheet from a stack of sheets in a process direction. In an embodiment, actuation 505 of the nudger roll may include generating a signal by a sensor, such as 412 in FIG. 4, located, for example, proximate to a process direction side (i.e., an exit point) of a feed nip. Alternate locations for the sensor may include at an entry point or an exit point of the take away nip, such as 432 in FIG. 4. The generated signal may indicate, for example, that no sheet is present at the location of the sensor. In response to at least the generated signal, the nudger roll may be moved into contact with a top sheet on a stack of sheets and may rotate in a manner designed to move the first sheet in a process direction.

A lead edge of the first sheet may be received 510 at a feed nip. The feed nip may include a feed roll and a retard roll, such as the ones described above in reference to FIG. 4. The feed roll may move 515 the first sheet through the first nip. In an embodiment, the retard roll may prevent one or more second sheets from passing through the first nip.

A trailing edge retention system may be actuated 520 to restrict movement of one or more second sheets in the stack of sheets. In an embodiment, actuation 520 of the trailing edge retention system may include generating a signal by a sensor located, for example, proximate to the exit point of a feed nip, such as 412 in FIG. 4. The generated signal may indicate, for example, that the first sheet is present at the location of the sensor. In response to at least the generated signal, the trailing edge retention system may be moved into contact with one or more second sheets on a stack of sheets to restrict movement of the one or more second sheets.

The lead edge of the first sheet may be received 525 at the take away nip. The take away nip may include a take away roll and an idler roll, such as described above in reference to FIG. 4. The take away roll may move the first sheet through the take away nip.

One or more of the feed roll and the retard system may be automatically moved 530 from the first sheet. In an embodiment, movement 530 of the feed roll and/or the retard system may be performed by generating a signal by a sensor located, for example, proximate to the exit point of the take away nip. The generated signal may indicate, for example, that the first sheet is present at the location of the sensor. In response to at least the generated signal, the feed roll and/or the retard system may be moved 530 away from the first sheet. As a result, drag on the first sheet may be reduced.

In an embodiment, the feed roll and/or the retard system may be moved 535 towards the other in order to prepare for reception of a new sheet. In an embodiment, movement 535 of the feed roll and/or the retard system may be performed in response to the generation of a signal by a sensor located, for example, proximate to the exit point of a feed nip. The generated signal may indicate, for example, that the first sheet is not present at the location of the sensor. In response to at least the generated signal, the retard roll or feed roll could be moved to once again form a nip.

The trailing edge retention system may be automatically moved 540 from the one or more second sheets. In an embodiment, movement 540 of the trailing edge retention system may include generating a signal by a sensor located, for example, proximate to the exit point of a feed nip. The generated signal may indicate, for example, that the first sheet is not present at the location of the sensor. In response to at least the generated signal, the trailing edge retention system may be moved 540 away from the one or more second sheets.

Significantly reduced wear on elastomer feed rolls and retard rolls may result from using a friction retard roll according to the principles described herein. The reduction in wear may result primarily because the feed nip is open for much of the feed cycle. In current active friction retard feeders, the retard roll works to separate the top sheet from the rest of the stack, but then continues to exert a force during the entire time that the sheet is being driven through the feed nip. In the disclosed embodiments, the retard/feed nip is opened after the top sheet reaches the take away nip, so that the retard and feed rolls are not being worn during much of the feed cycle. In particular, a retard roll may see the greatest improvement in wear reduction because it is not slipping against paper or rotating against the feed roll when the feed nip is open. In addition, a significant reduction in wear of the slip clutch of the retard system may also result because the feed nip is open for much of a sheet feeding cycle.

Table 1 provides information pertaining to the reduction of wear on the feed roll and retard roll for exemplary distances. If the distance between the feed nip and the take away nip is approximately 75 mm and the feed nip is released after approximately 20 mm of the sheet reaches the take away roll, the reduction in overall wear time on the feed roll 410 and the retard roll 415 for a standard 8.5"×11" (216 mm×279 mm) sheet is approximately $$56\%\left(\frac{216-95}{216}\right).$$

For a 11"×17" (279 mm×432 mm) sheet in the same system, the reduction in overall wear time on the feed roll 410 and the retard roll 415 is approximately $$78\%\left(\frac{432-95}{432}\right).$$

As such, a system developed in accordance with the principles taught in this disclosure could potentially more than double the life of the feed roll 410 and the retard roll 415 for letter sized paper and could potentially increase the roll life by a factor of approximately 4.5 for large format media. This reduction in wear rate means that the feed nip can feed a greater number of sheets before the rolls have to be replaced. This reduces service costs and run costs for the machine.

TABLE 1

Reduction in Feed and Retard Roll Wear

| Feed Nip to TAR (mm) | Sheet Length (mm) | Dist for Nip Release (mm) | % Reduction in Wear |
|---|---|---|---|
| 75 | 216 | 20 | 56 |
| 75 | 432 | 20 | 78 |

In addition, reduction in wear for a take away roll may result through use of a friction retard feeder designed according to the principles disclosed herein. Conventional feeders accelerate sheets to a higher velocity after the sheet reaches the take away roll. Because of this, an over-running clutch is typically included in the feed roll drive system that allows the feed roll to spin faster than it is being driven. However, the sheet must still overcome the feed roll drag force and the retard roll slip-clutch drag force in a conventional system. Because the feed nip is opened shortly after the sheet reaches the take away roll in the presently disclosed embodiments, the take away roll does not need to overcome the drag forces for a significant period of time when accelerating the sheet. Reducing the drag forces may reduce the risk of marking sensitive coated media from the rolls and requires less drive torque/power on the take away roll.

Additional benefits that may result include less marking of a coated media (both from the feed nip and from the take away roll force pulling the sheet around any baffles in the device) and less roll contamination because the nip is open for much of the sheet feed cycle. Roll contamination can cause a decrease in the coefficient of friction for the roll because the contaminant may cause the roll to slip with respect to a sheet that is being transferred. As the coefficient of friction is lowered, it becomes more likely that a second sheet will be transported through the feed nip to the remainder of the document processing system, causing a malfunction in a document processing operation.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A sheet feeding system, comprising:

a feed roll configured to drive a first sheet of a stack of sheets in a process direction;

a retard system configured to prevent one or more second sheets from being driven in the process direction;

a trailing edge retention arm configured to automatically and selectively retain one or more second sheets in the stack by applying a force to a trailing portion of at least one second sheet, wherein the trailing edge retention arm is actuated based on first data provided by at least one of a plurality of sensors to automatically and selectively retain the one or more second sheets; and a separating system for automatically and selectively separating the feed roll and the retard system, wherein the separating system is actuated based on second data provided by at least one of the plurality of sensors to automatically and selectively separate the feed roll and the retard system;

a nudger roll configured to move the first sheet from the stack of sheets in the process direction, wherein the nudger roll is configured to be actuated, based on third data provided by at least one of the plurality of sensors, after a previous sheet has passed through the feed roll and the retard system, wherein the nudger roll and at least one of the trailing edge retention arm and the separating system have a common actuator.

2. The system of claim 1, wherein the retard system comprises a friction pad.

3. The system of claim 1, wherein the retard system comprises:

a shaft;

a rotatably mounted retard roll; and a slip clutch coupled to the shaft and the retard roll and configured to prevent the retard roll from rotating if a second sheet contacts the retard roll and to enable the retard roll to rotate in a process direction if a first sheet contacts the retard roll.

4. The system of claim 1, wherein the retard system comprises:

a rotatably mounted retard roll;

a drive shaft for applying a torque on the retard roll of a magnitude and direction that rotates the retard roll in a non-process direction opposite to the process direction; and a slip clutch coupled to the retard roll and the drive shaft and configured to prevent the retard roll from rotating in the non-process direction if a first sheet contacts the retard roll and to enable the retard roll to rotate in the non-process direction if a second sheet contacts the retard roll.

5. The system of claim 1, wherein the trailing edge retention arm and the system for automatically separating the feed roll and the retard system have a common actuator.

6. The system of claim 1, wherein a distance between a trailing edge of the stack and the trailing edge retention arm is greater than the distance between a leading edge of the stack and the feed roll.

7. The system of claim 1, wherein the separating system is configured to automatically separate the feed roll and the retard system after a lead edge of the top sheet has reached a take away nip, wherein the take away nip is located in a process direction with respect to the feed roll.

8. The system of claim 1, wherein the trailing edge retention arm is configured to be actuated after the top sheet has passed through the feed roll.

* * * * *